US007186151B2

(12) United States Patent
Komiyama

(10) Patent No.: US 7,186,151 B2
(45) Date of Patent: Mar. 6, 2007

(54) ELECTRICAL CONNECTOR, WIRE HARNESS, AND METHOD FOR ARRANGING WIRE HARNESS

(75) Inventor: Ryuichi Komiyama, Tokyo (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 11/279,081

(22) Filed: Apr. 7, 2006

(65) Prior Publication Data

US 2006/0228932 A1 Oct. 12, 2006

(30) Foreign Application Priority Data

Apr. 8, 2005 (JP) ..... 2005-112601

(51) Int. Cl.
*H01R 13/502* (2006.01)

(52) U.S. Cl. ..... 439/701; 439/467; 439/596; 439/492

(58) Field of Classification Search ..... 439/467, 439/596, 701, 492, 499, 67
See application file for complete search history.

(56) References Cited

U.S. PATENT DOCUMENTS 5,154,630 A * 10/1992 Kamono et al. ..... 439/352
6,428,345 B2 * 8/2002 Sawayanagi et al. ..... 439/456

FOREIGN PATENT DOCUMENTS

JP 4-129181 * 4/1992 ..... 439/701
JP 10-074541 3/1998

* cited by examiner

*Primary Examiner*—Tho D. Ta
(74) *Attorney, Agent, or Firm*—Barley Snyder LLC

(57) ABSTRACT

An electrical connector connected to a flat cable, a wire harness, and a method for arranging wire harness is disclosed. Arranging the wire harness is easy and simple, the cost is low, and the degree of freedom in the housing construction is high. The electrical connector 10 has a plurality of mutually stackable base housings 11*a*, 11*b*, and 11*c* having the same shape, with each of these base housings 11*a*, 11*b*, and 11*c* having contact receiving cavities 16*a*, 16*b*, and 16*c* in a single row. At least one lock housing 40 is attached to the uppermost and/or lowermost base housing of the plurality of stacked base housings 11*a*, 11*b*, and 11*c*. A plurality of contacts 30*a*, 30*b*, and 30*c* are connected to the flat cable 2 and are inserted in the contact receiving cavities 16*a*, 16*b*, and 16*c*.

4 Claims, 10 Drawing Sheets

ELECTRICAL CONNECTOR, WIRE HARNESS, AND METHOD FOR ARRANGING WIRE HARNESS

FIELD OF THE INVENTION

The present invention relates to an electrical connector and more particularly to an electrical connector for a flat cable, a wire harness, and a method for arranging the wire harness.

BACKGROUND OF THE INVENTION

Wire harnesses in which electrical connectors are connected to flat cables, including flexible circuit boards (FPC), have been used in the past mainly in electronic devices such as personal computers. In recent years, however, there has been an increasing demand for the use of such wire harnesses for the connection to controllers in the automotive field or the like.

For example, wire harnesses in which electrical connectors are connected to flat cables are used for the connection to automotive transmission controllers. In such cases, installation involves pulling an electrical connector connected to the end portion of a flat cable out of an opening in the transmission case.

In such cases, when a multipole connector in which a plurality of contacts are arranged in multiple rows is used as an electrical connector, the size of the electrical connector is increased, so that the opening bored in the transmission case is also inevitably increased. In order to solve this problem, a method is conceivable in which a plurality of stackable connectors each having a plurality of contacts arranged in a single row are prepared, the plurality of connectors are connected to the end portion of a flat cable, the individual connectors are successively pulled out through a relatively small opening bored in the transmission case, and the individual connectors are subsequently stacked up and integrated.

The connector shown in FIGS. 12 and 13A to 13C (see JP10-74541A), for example, is a known stackable connector in which a plurality of contacts are arranged in a single row. FIG. 12 is a perspective view of the upper-stage, middle-stage, and lower-stage base housings and FIGS. 13A to 13C are explanatory diagrams of such a conventional connector assembly.

This connector 101 shown in FIG. 12 comprises upper-stage, middle-stage, and lower-stage base housings 110*a*, 110*b*, and 110*c*, and a plurality of contacts 120 (see FIGS. 13A to 13C) inserted in the respective base housings 110*a*, 110*b*, and 110*c*.

A plurality of contact receiving cavities 111 in a single row having the upper surfaces thereof open are formed in the upper-stage base housing 110*a*, and a cover body 115 that covers the upper surfaces of the contact receiving cavities 111 is integrally formed and joined by hinges 115*a* to the upper-stage base housing 110*a*. A pair of locking projections 116 are formed at either end of the cover body 115, and a pair of locking recesses 114 with which the locking projections 116 are locked are formed in either side wall of the base housing 110*a*.

Furthermore, a plurality of contact receiving cavities 111 in a single row having the upper surfaces thereof open are also formed in the middle-stage base housing 110*b*.

Moreover, a plurality of contact receiving cavities 111 in a single row having the upper surfaces thereof open are likewise formed in the lower-stage base housing 110*c*.

In addition, the upper-stage, middle-stage, and lower-stage base housings 110*a*, 110*b*, and 110*c* are arranged so that these base housings 110*a*, 110*b*, and 110*c* are linked in a staircase like pattern with the upper surfaces of the contact receiving cavities 111 in each of the base housings 110*a*, 110*b*, and 110*c*. The upper-stage and middle-stage base housings 110*a* and 110*b* are linked by a frangible thin part 117*a*, the middle-stage and lower-stage base housings 110*b* and 110*c* are linked by a frangible thin part 117*b*, and these upper-stage, middle-stage, and lower-stage base housings 110*a*, 110*b*, and 110*c* are formed integrally from an insulative material. Furthermore, these base housings 110*a*, 110*b*, and 110*c* are constructed so that the middle-stage base housing 110*b* can be stacked on top of the lower-stage base housing 110*c*, and so that the upper-stage base housing 110*a* can be stacked on top of the middle-stage base housing 110*b*. A pair of locking projections 112 are formed on the bottom wall of the middle-stage base housing 110*b*, and a pair of locking recesses 113 are formed in either side wall of the lower-stage base housing 110*c* to engage the locking projections 112 when the middle-stage base housing 110*b* is stacked. Likewise, a pair of locking projections 112 are formed on the bottom wall of the upper-stage base housing 110*a*, and a pair of locking recesses 113 are formed in either side wall of the middle-stage base housing 110*b* to engage the locking projections 112 when the upper-stage base housing 110*a* is stacked.

As is shown in FIG. 13A, when assembling the connector 101, the contacts 120 are first inserted into the contact receiving cavities 111 of the respective base housings 110*a*, 110*b*, and 110*c*, and individual electrical wires W are connected by Insulation Displacement Connection (IDC) to the respective contacts 120 in this state.

Next, as is shown in FIG. 13B, the thin part 117*a* that links the upper-stage base housing 110*a* and middle-stage base housing 110*b* and the thin part 117*b* that links the middle-stage base housing 110*b* and lower-stage base housing 110*c* are cut.

Finally, as is shown in FIG. 13C, the middle-stage base housing 110*b* is stacked on top of the lower-stage base housing 110*c*, and the upper-stage base housing 110*a* is stacked on top of the middle-stage base housing 110*b*. Subsequently, the cover body 115 provided on the upper-stage base housing 110*a* is pivoted in the direction of arrow A shown in FIG. 12 to cover the upper surfaces of the respective contact receiving cavities 111. As a result, the connector 101 is completed.

With this connector 101, since a plurality of base housings 110*a*, 110*b*, and 110*c* are formed by a single molding process as one linked body, the number of parts can be reduced, and the work efficiency can be increased as a result of the simplification of the parts.

In the connector 101 shown in FIGS. 12 and 13A to 13C, individual electrical wires W are connected by IDC to the respective contacts 120, but it would also be possible to connect the end portion of a flat cable to the respective contacts 120. Furthermore, if the thin parts 117*a* and 117*b* are cut following the connection of the flat cable to the respective contacts, the individual base housings 110*a*, 110*b*, and 110*c* are pulled out of the opening in the transmission case, and the individual base housings 110*a*, 110*b*, and 110*c* are subsequently stacked up, then the opening in the transmission case or the like can be made smaller.

However, in the case of the connector 101 shown in FIGS. 12 and 13A to 13C, while arranging the wire harness, it is necessary to cut the thin parts 117*a* and 117*b* that are provided in order to form a plurality of base housings 110*a*,

110*b*, and 110*c* as one linked body in a single molding process. Therefore, there is a problem in that arranging the wire harness becomes troublesome.

Furthermore, in cases where the number of contacts 120 is increased or decreased in the connector 101, the number of base housings must be increased or decreased. However, since thin parts that link adjacent base housings are present, the degree of freedom in the housing construction is low, and a new mold for molding base housings is required in such cases, so that manufacturing is complicated, and there is a concern of increased cost.

SUMMARY

Accordingly, the present invention was devised in light of the problems described above. It is an object of the present invention to provide an electrical connector connected to a flat cable, a wire harness, and a method for arranging a wire harness in which arranging the wire harness is simple and easy, the cost is low, and the degree of freedom in the housing construction is high.

An electrical connector according to am embodiment of the invention has a plurality of mutually stackable base housings having the same shape, with each of these base housings having contact receiving cavities in a single row. At least one lock housing is attached to the uppermost and/or lowermost one of the stacked base housings and a plurality of contacts that are connected to the flat cable are inserted into the contact receiving cavities in the plurality of base housings.

Furthermore, a method for arranging wire harness comprises the steps of: connecting a plurality of contacts to a flat cable; inserting the plurality of contacts in the contact receiving cavities in a single row in a plurality of base housings; passing each of the plurality of base housings successively through an opening in a housing; stacking the plurality of base housings; and attaching at least one lock housing to the uppermost and/or lowermost base housing of the plurality of stacked base housings.

BRIEF DESCRIPTION OF THE DRAWINGS

The invention will now be described by way of example with reference to the following Figures of which.

DETAILED DESCRIPTION OF THE EMBODIMENTS

Figure 1:
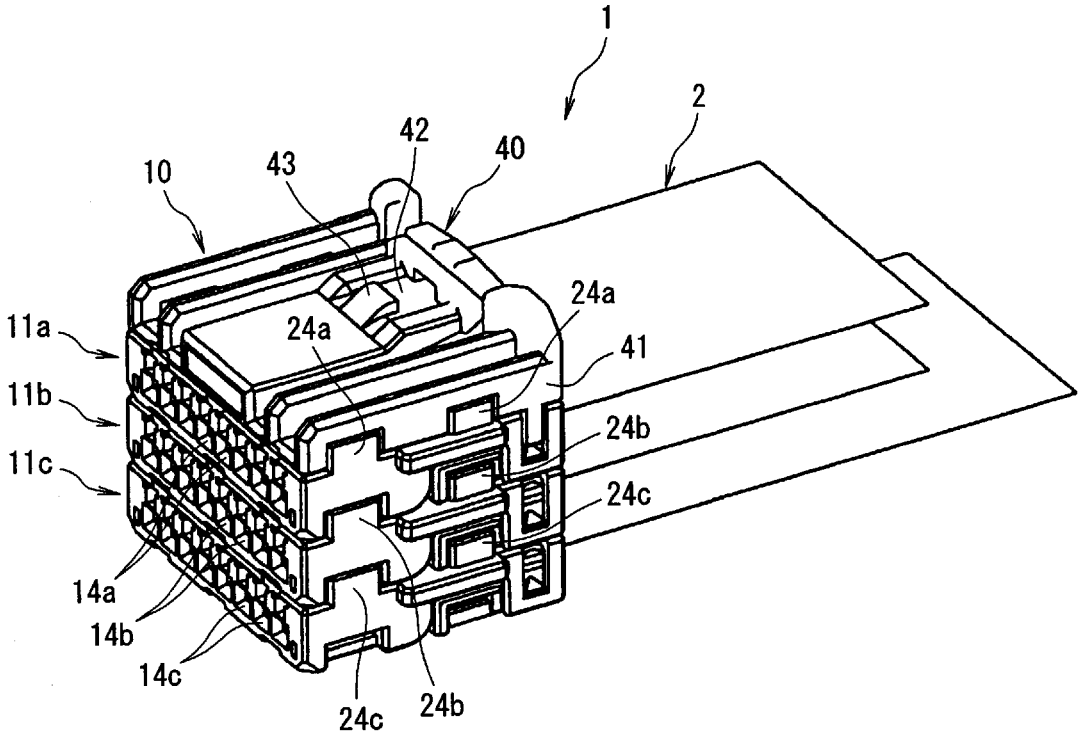
FIG. 1 is a perspective view of the wire harness of the present invention as seen from above and from the front.
Figure 2:
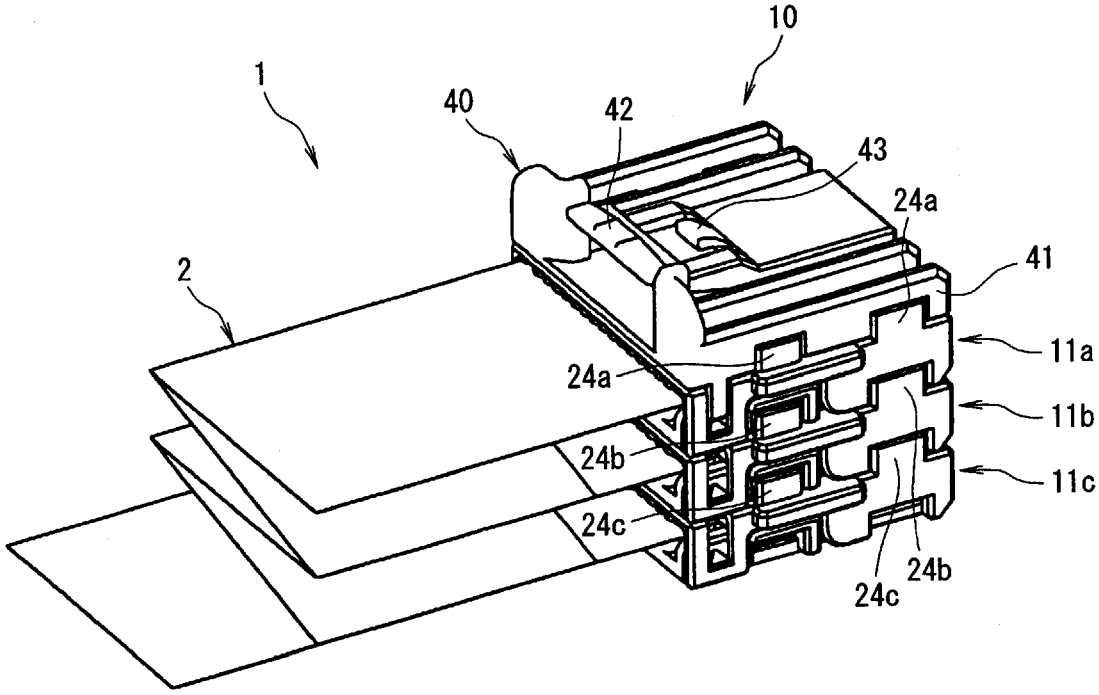
FIG. 2 is a perspective view of the wire harness shown in FIG. 1 as seen from above and from the back.
Figure 3A:
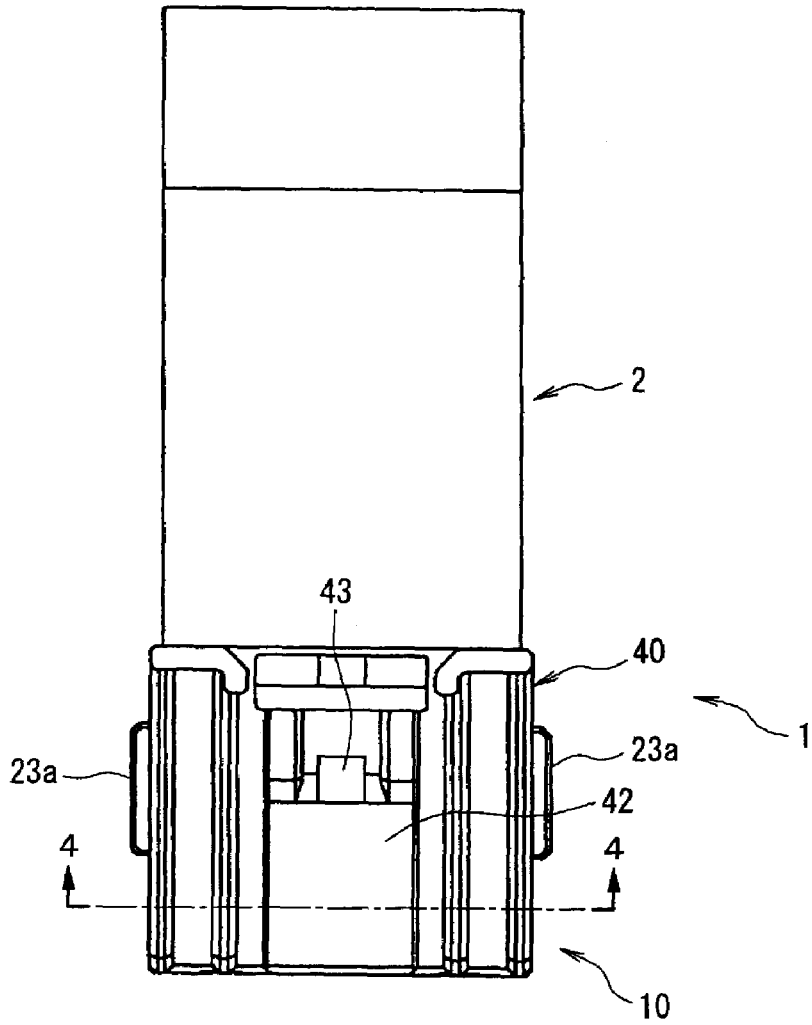
FIGS. 3A and 3B show the wire harness of FIG. 1, with FIG. 3A being a plan view, and FIG. 3B being a front view.
Figure 3B:
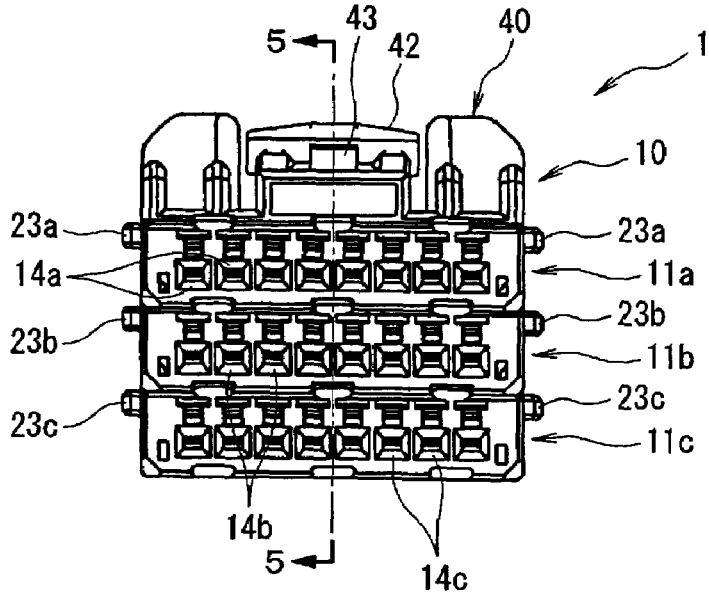
Figure 4:
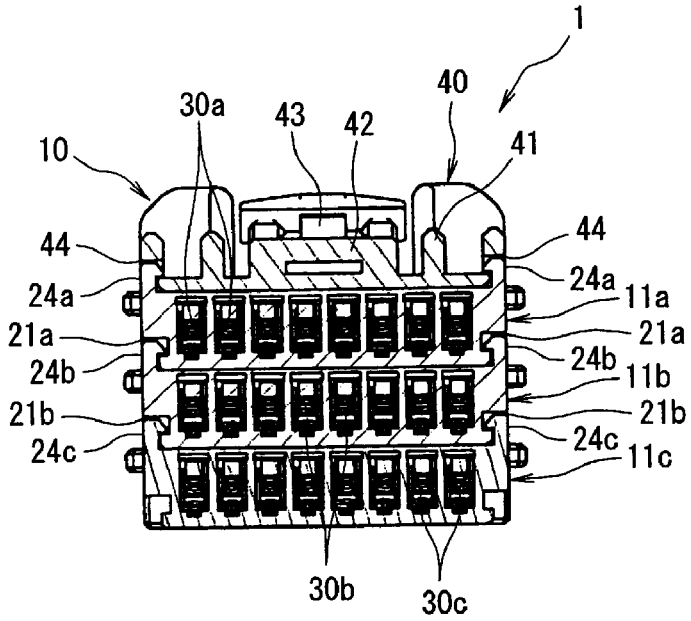
FIG. 4 is a sectional view along line 4—4 in FIG. 3A.
Figure 5:
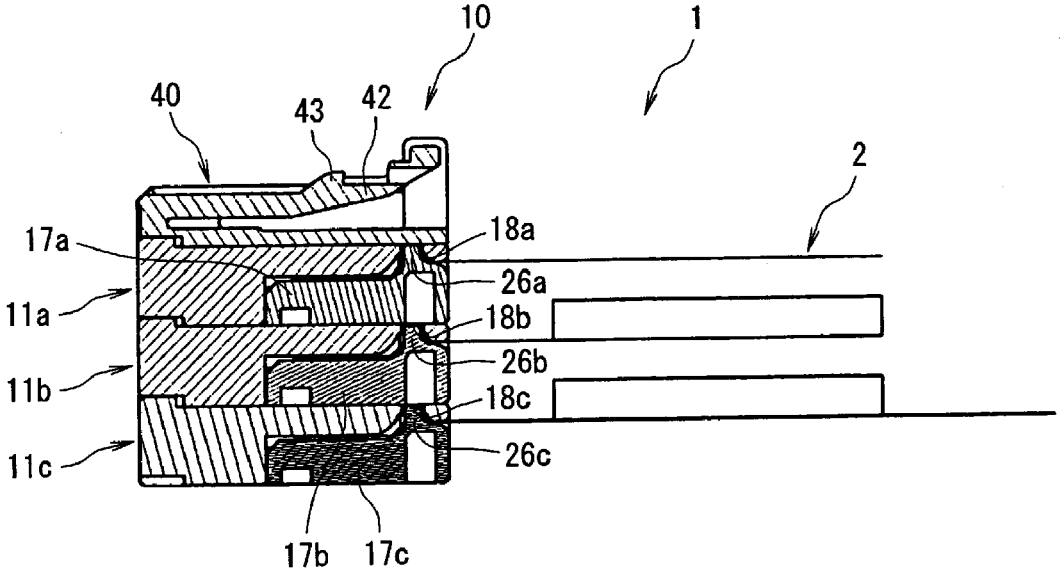
FIG. 5 is a sectional view along line 5—5 in FIG. 3B.
Figure 6:
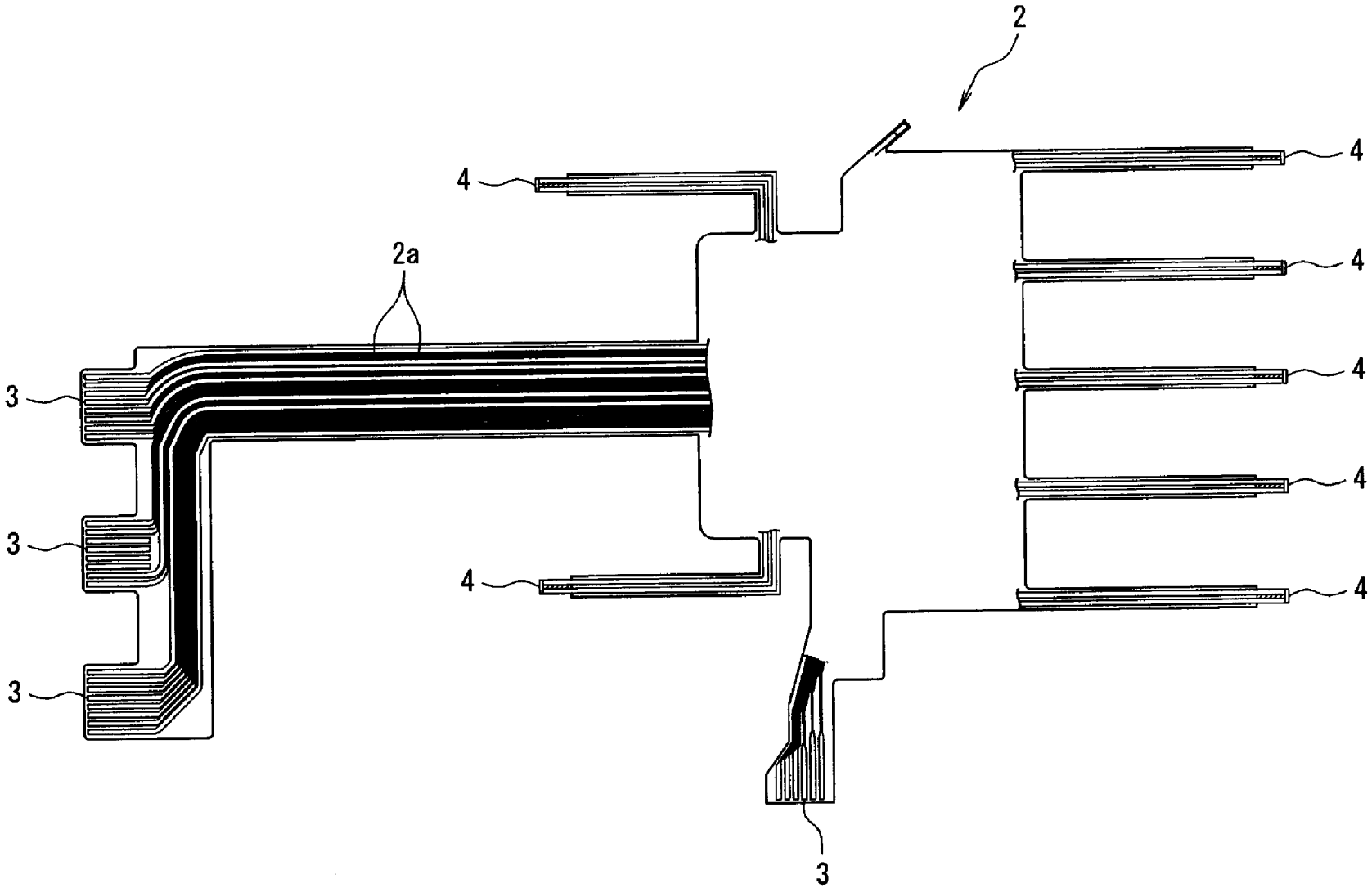
FIG. 6 is a schematic plan view of a flexible circuit board (FPC)

Next, an embodiment of the present invention will be described with reference to the figures. Referring to FIGS. 1 through 5, the wire harness 1 is formed by connecting an electrical connector 10 to one end of a flexible circuit board (FPC) 2. Here, as is shown in FIG. 6, for example, a FPC 2 is used which has a plurality of conductor patterns 2*a* on one surface thereof, and which comprises three first terminal sections 3 on one end, five second terminal sections 4 on the other end, and one first terminal section 3 and two second terminal sections 4 substantially in the central portion.

Here, the electrical connector 10 comprises mutually stackable upper-stage, middle-stage, and lower-stage base housings 11*a*, 11*b*, and 11*c* that have the same shape, and a lock housing 40. Although the electrical connector 10 is not limited to a connector comprising upper-stage, middle-stage, and lower-stage base housings 11*a*, 11*b*, and 11*c*, i.e., three stages of base housings, a case in which the connector comprises base housings in three stages will be described below.

Figure 7:
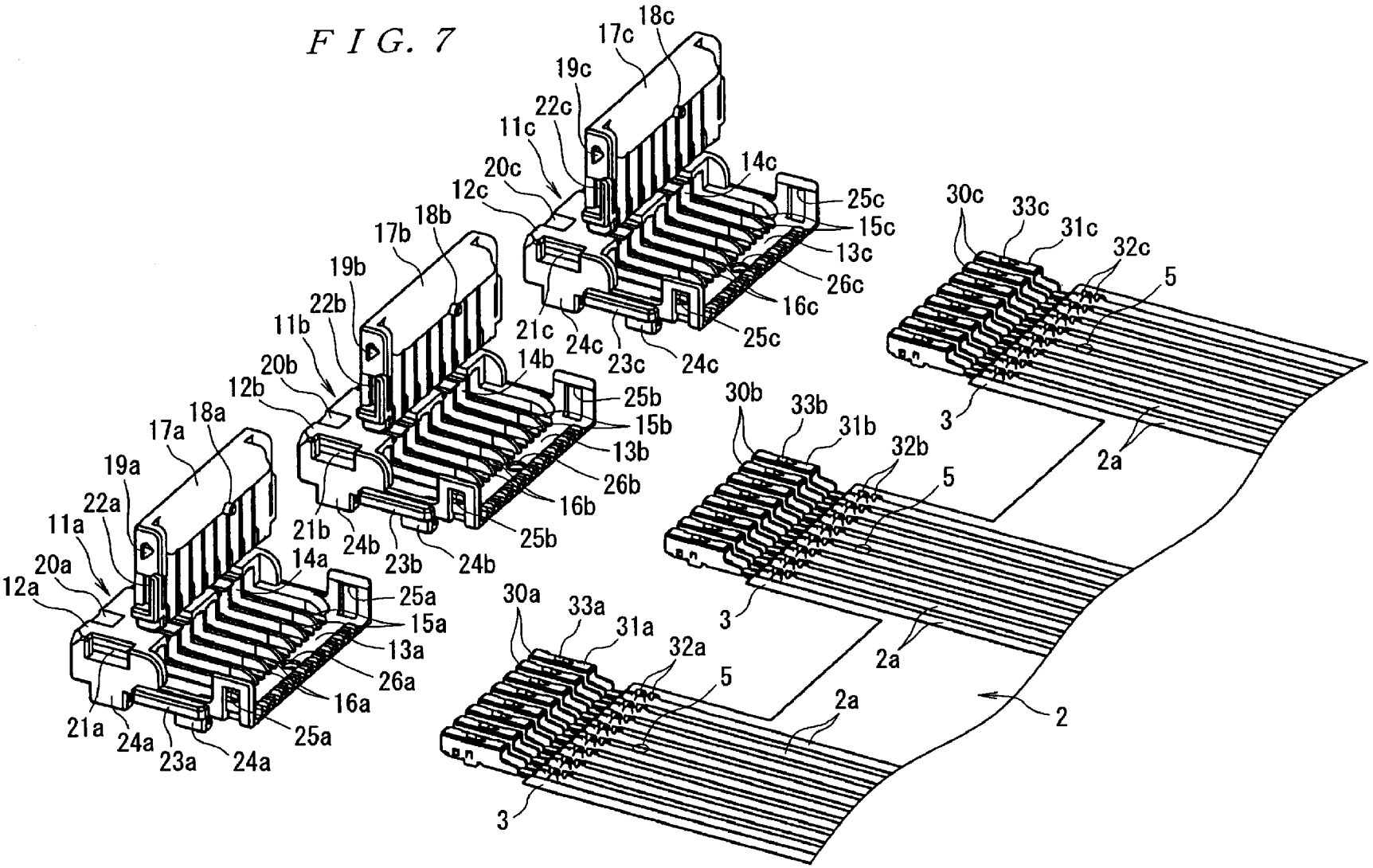
FIG. 7 is a perspective view illustrating a step of inserting a plurality of contacts connected to the FPC in the contact receiving cavities of upper-stage, middle-stage, and lower-stage base housings.

As is shown most clearly in FIG. 7, the upper-stage base housing 11*a* comprises a substantially rectangular housing main body 12*a* that has a plurality of contact receiving holes 14*a* in a single row, and a bottom plate part 13*a* that extends rearward (rightward in FIG. 7) from the housing main body 12*a*. The upper-stage base housing 11*a* is formed by molding an insulative material. A plurality of pairs of side walls 15*a* that extend rearward from the rear surface of the housing main body 12*a* in positions corresponding to both sides of the contact receiving holes 14*a* are formed on the bottom plate part 13*a*, and contact receiving cavities 16*a* are defined by the contact receiving holes 14*a* and the spaces between the pairs of side walls 15*a*. Thus, the plurality of contact receiving cavities 16*a* in a single row are formed in the upper-stage base housing 11*a*. Furthermore, a strain relief member 17*a* is integrally provided via a hinge part 27*a* (see FIG. 9) on the undersurface (upper surface in FIG. 7) of the housing main body 12*a* of the upper-stage base housing 11*a*. A strain relief projection 18*a* is formed so as to protrude substantially from the central portion in the direction of width of the strain relief member 17*a*, and a recess 26*a* into which the strain relief projection 18*a* is inserted is formed in the bottom plate part 13*a*. Moreover, a pair of locking projections 19*a* are provided on either side surface of the strain relief member 17*a* and a pair of locking parts having locking holes 25*a* with which the locking projections 19*a* are locked are provided in an upright attitude on the bottom plate part 13*a*. In addition, a plurality of protruding parts 28*a* (see FIG. 11) are provided on the upper surface of the housing main body 12*a*, and a pair of locking projections 24*a* that protrude upward are also provided on either side of the housing main body 12*a*. Furthermore, a pair of locking projections 24*a* that protrude upward are provided on either side of the bottom plate part 13*a* as well. These locking projections 24*a* respectively engage with locking recesses 44 formed in the lock housing 40, and the protruding parts 28*a* are fitted into grooves 45 formed in the lock housing 40, so that these parts have the function of preventing excessive looseness of the lock housing 40. Moreover, a plurality of grooves 20*a* are formed in the undersurface of the housing main body 12*a*, and a pair of locking recesses 21*a* are formed at either side of the housing main body 12*a* beneath the locking projections 24*a*. In addition, a pair of locking recesses 22*a* are also formed in either side of the strain relief member 17*a*.

Furthermore, the middle-stage base housing 11*b* has the same shape as the upper-stage base housing 11*a*, and comprises a substantially rectangular housing main body 12*b* that has a plurality of contact receiving holes 14*b* in a single row, and a bottom plate part 13*b* that extends rearward from the housing main body 12*b* as shown most clearly in FIG. 7. The middle-stage base housing 11*b* is formed by molding an insulative material. A plurality of pairs of side walls 15*b* that extend rearward from the rear surface of the housing main body 12*b* in positions corresponding to both sides of the contact receiving holes 14*b* are formed on the bottom plate part 13*b*, and contact receiving cavities 16*b* are demarcated by the contact receiving holes 14*b* and the spaces between the pairs of side walls 15*b*. Thus, the plurality of contact receiving cavities 16*b* in a single row are formed in the middle-stage base housing 11*b*. Furthermore, a strain relief member 17*b* is integrally provided via a hinge part 27*b* (see FIG. 9) on the undersurface (upper surface in FIG. 7) of the housing main body 12*b* of the middle-stage base housing 11*b*. A strain relief projection 18*b* is formed so as to protrude substantially from the central portion in the direction of width of this strain relief member 17*b*, and a hole 26*b* into which the strain relief projection 18*b* is inserted is formed in the bottom plate part 13*b*. Moreover, a pair of locking projections 19*b* are provided on either side surface of the strain relief member 17*b* in the direction of width, and a pair of locking parts having locking holes 25*b* with which the locking projections 19*b* are locked are installed in an upright attitude on the bottom plate part 13*b*. In addition, a plurality of protruding parts (not shown in the figures) are provided on the upper surface of the housing main body 12*b*, and a pair of locking projections 24*b* that protrude upward are also provided on either side of the housing main body 12*b*. Furthermore, a pair of locking projections 24*b* that protrude upward are provided on either side of the bottom plate part 13*b* as well. These locking projections 24*b*, 24*b* respectively engage with the locking recesses 21*a*, 22*a* formed in the upper-stage base housing 11*a*, and the protruding parts are fitted into the grooves 20*a* formed in the upper-stage base housing 11*a*. Moreover, a plurality of grooves 20*b* are formed in the undersurface of the housing main body 12*b*, and a pair of locking recesses 21*b* are formed at either side of the housing main body 12*b* beneath the locking projections 24*b*. In addition, a pair of locking recesses 22*b* are also formed in either side of the strain relief member 17*b*.

Furthermore, the lower-stage base housing 11*c* has the same shape as the upper-stage base housing 11*a* and middle-stage base housing 11*b*, and comprises a substantially rectangular housing main body 12*c* that has a plurality of contact receiving holes 14*c* in a single row, and a bottom plate part 13*c* that extends rearward from the housing main body 12*c* as shown most clearly in FIG. 7; the lower-stage base housing 11*c* is formed by molding an insulating resin. A plurality of pairs of side walls 15*c* that extend rearward from the rear surface of the housing main body 12*c* in positions corresponding to both sides of the contact receiving holes 14*c* are formed on the bottom plate part 13*c*, and contact receiving cavities 16*c* are demarcated by the contact receiving holes 14*c* and the spaces between the pairs of side walls 15*c*. Thus, the plurality of contact receiving cavities 16*c* in a single row are formed in the lower-stage base housing 11*c*. Furthermore, a strain relief member 17*c* is integrally provided via a hinge part 27*c* (see FIG. 9) on the undersurface (upper surface in FIG. 7) of the housing main body 12*c* of the lower-stage base housing 11*c*. A strain relief projection 18*c* is formed so as to protrude substantially from the central portion in the direction of width of this strain relief member 17*c*, and a hole part 26*c* into which the strain relief projection 18*c* is inserted is formed in the bottom plate part 13*c*. Moreover, a pair of locking projections 19*c* are provided on either side surface of the strain relief member 17*c* in the direction of width, and a pair of locking parts having locking holes 25*c* with which the locking projections 19*c* are locked are installed in an upright attitude on the bottom plate part 13*c*. In addition, a plurality of protruding parts (not shown in the figures) are provided on the upper surface of the housing main body 12*c*, and a pair of locking projections 24*c* that protrude upward are also provided on either side of the housing main body 12*c*. Furthermore, a pair of locking projections 24*c* that protrude upward are provided on either side of the bottom plate part 13*c* as well. These locking projections 24*c*, 24*c* respectively engage with the locking recesses 21*b*, 22*b* formed in the middle-stage base housing 11*b*, and the protruding parts are fitted into the grooves 20*b* formed in the middle-stage base housing 11*b*. Moreover, a plurality of grooves 20*c* are formed in the undersurface of the housing main body 12*c*, and a pair of locking recesses 21*c* are formed at either side of the housing main body 12*c* beneath the locking projections 24*c*. In addition, a pair of locking recesses 22*c* are also formed in either side of the strain relief member 17*c*. Thus, the lower-stage base housing 11*c* is constructed so that another base housing having the same shape as the upper-stage, middle-stage, and lower-stage base housings 11*a*, 11*b*, and 11*c* can also be stacked underneath this lower-stage base housing 11*c*. Furthermore, a pair of projections 23*a*, 23*b*, and 23*c* for preventing twisting during mating with a mating connector (not shown in the figures) are respectively provided on either end surface in the direction of width of the upper-stage, middle-stage, and lower-stage base housings 11*a*, 11*b*, and 11*c*.

Moreover, the lock housing 40 is to be attached to the surface of the upper-stage base housing 11*a* that is located in the uppermost position of the stacked upper-stage, middle-stage, and lower-stage base housings 11*a*, 11*b*, and 11*c*. The lock housing 40 comprises a substantially rectangular lock housing main body 41, a cantilever locking arm 42 that is provided substantially in the central portion of the lock housing main body 41 in the direction of width, and a locking projection 43 that is provided on the upper surface of the locking arm 42; the lock housing 40 is formed by molding an insulating resin. The locking projection 43 of the locking arm 42 engages with the locking part of a mating connector (not shown in the figures), thus having the function of preventing the electrical connector 10 from coming out of the mating connector. Furthermore, the locking recesses 44, 44 with which the locking projections 24*a*, 24*a* provided on the upper-stage base housing 11*a* respectively engage are formed in either side of the lock housing main body 41. In addition, a plurality of grooves 45 into which the protruding parts 28*a* provided on the upper-stage base housing 11*a* are fitted are formed in the undersurface of the lock housing main body 41.

Furthermore, as is shown in FIG. 7, a plurality of upper-stage contacts 30*a* are connected to the first terminal section 3 that is located on the rightmost side (left side in FIG. 7) of the three first terminal sections 3 provided on one end of the FPC 2, a plurality of middle-stage contacts 30*b* are connected to the first terminal section 3 located in the middle, and a plurality of lower-stage contacts 30*c* are connected to the first terminal section 3 located on the leftmost side. Among these connected contacts, the upper-stage contacts 30*a* are designed to be inserted into the contact receiving cavities 16*a* in the upper-stage base housing 11*a*, the middle-stage contacts 30*b* are designed to be inserted into the contact receiving cavities 16*b* in the middle-stage base housing 11*b*, and the lower-stage contacts 30*c* are designed to be inserted into the contact receiving cavities 16*c* in the lower-stage base housing 11*c*. The "electrical connector" stipulated in claim 1 is constructed form the upper-stage, middle-stage, and lower-stage base housings 11*a*, 11*b*, and 11*c*, lock housing 40, and upper-stage, middle-stage, and lower-stage contacts 30*a*, 30*b*, and 30*c*. Here, each of the upper-stage, middle-stage, and lower-stage contacts 30*a*, 30*b*, and 30*c* is formed by stamping and forming a metal plate, and comprises a substantially box-shaped receptacle part 31*a*, 31*b*, or 31*c* that receives a mating contact (not shown in the figures), a connecting part 32*a*, 32*b*, or 32*c* that extends from the receptacle part 31*a*, 31*b*, or 31*c* and that is connected to the corresponding first terminal section by piercing, and a locking part 33*a*, 33*b*, or 33*c* that is provided on the receptacle part 31*a*, 31*b*, or 31*c* and that is locked inside the contact receiving hole 14*a*, 14*b*, or 14*c*.

Next, a method for arranging wire harness will be described in reference to FIGS. 7 through 11.

For example, if a description is given in a case where the wire harness 1 is connected to a controller for an automotive transmission, first, as is shown in FIG. 7, the plurality of upper-stage contacts 30*a* are connected by piercing to the first terminal section 3 that is located on the rightmost side (left side in FIG. 7) of the three first terminal sections 3 provided on one end of the FPC 2, the plurality of middle-stage contacts 30*b* are connected by piercing to the first terminal section 3 located in the middle, and the plurality of lower-stage contacts 30*c* are connected by piercing to the first terminal section 3 located on the leftmost side.

Figure 8:
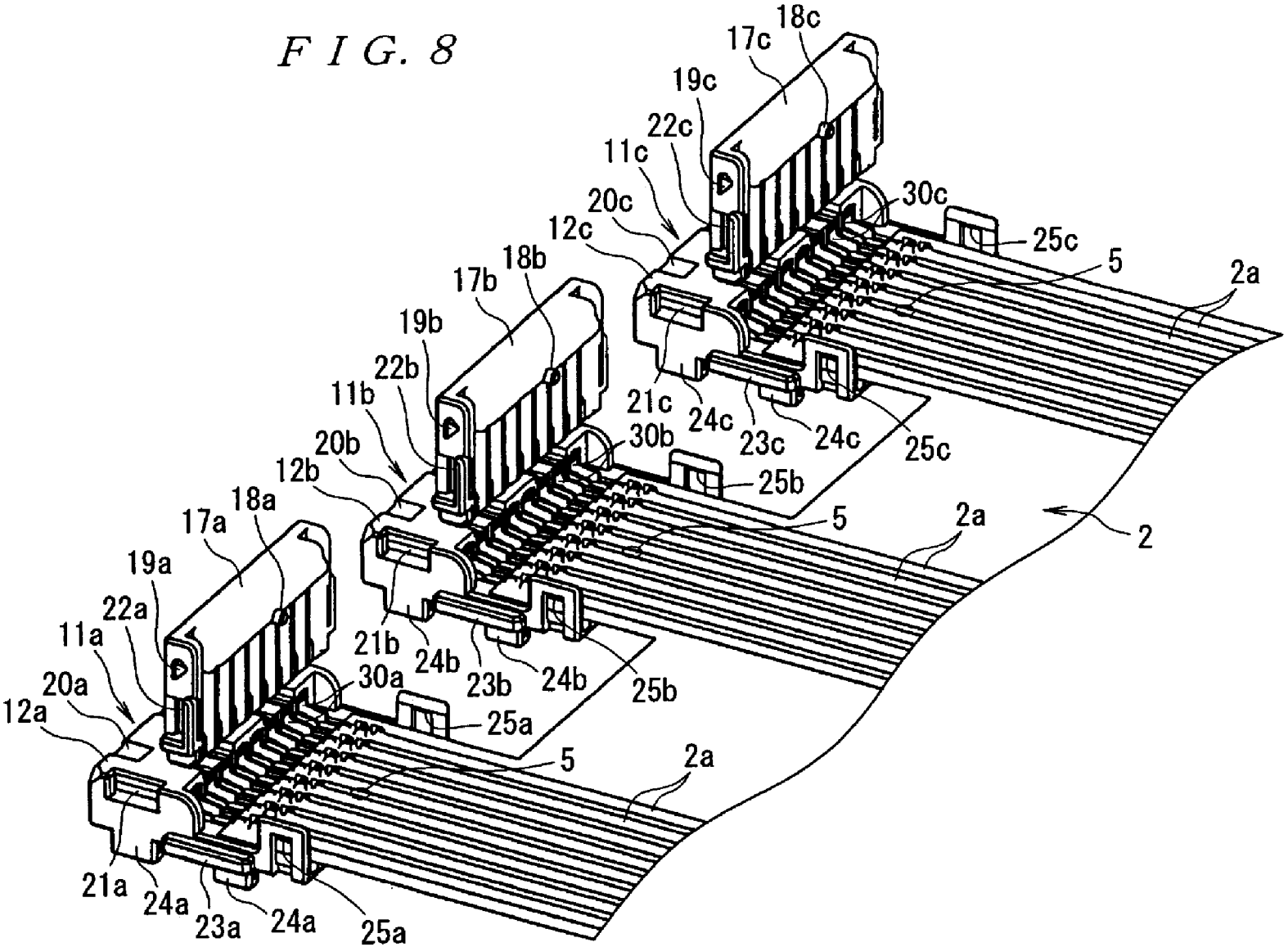
FIG. 8 is a perspective view illustrating a step of pivoting about hinge parts strain relief members respectively provided on the upper-stage, middle-stage, and lower-stage base housings.

Next, the plurality of upper-stage contacts 30*a* connected to the FPC 2 are inserted into the contact receiving cavities 16*a* in a single row in the upper-stage base housing 11*a*, the plurality of middle-stage contacts 30*b* are inserted into the contact receiving cavities 16*b* in a single row in the middle-stage base housing 11*b*, and the plurality of lower-stage contacts 30*c* are inserted into the contact receiving cavities 16*c* in a single row in the lower-stage base housing 11*c*. As a result, the state shown in FIG. 8 is obtained.

Figure 9:
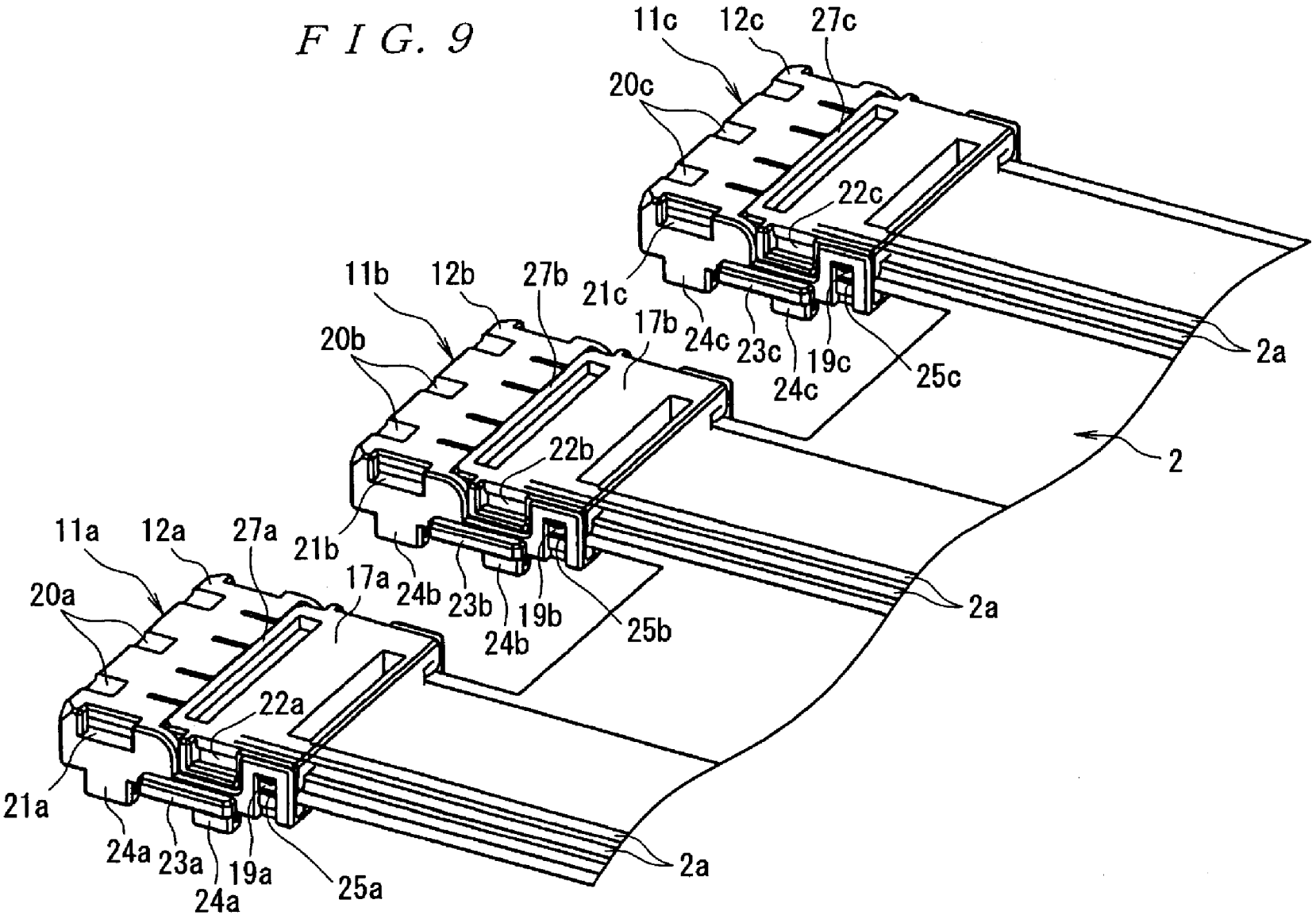
FIG. 9 is a perspective view in a state in which the strain relief members are pivoted about the hinge parts.

Then, the strain relief member 17*a* provided on the upper-stage base housing 11*a* is caused to pivot about the hinge part 27*a*, so that the strain relief projection 18*a* is engaged with the hole part 26*a* via an opening 5 formed in the FPC 2. At this point, the locking projections 19*a* are locked with the locking holes 25*a*, so that the strain relief member 17*a* is locked. As a result, in cases where an external force is applied to the FPC 2, it is possible to relieve the stress generated in the first terminal section 3 of the FPC 2 to which the upper-stage contacts 30*a* are connected. Furthermore, the strain relief member 17*b* provided on the middle-stage base housing 11*b* is similarly caused to pivot about the hinge part 27*b*, so that the strain relief projection 18*b* is engaged with the hole 26*b* via an opening 5 formed in the FPC 2, and the locking projections 19*b* are locked with the locking holes 25*b*, thus locking the strain relief member 17*b*. As a result, in cases where an external force is applied to the FPC 2, it is possible to relieve the stress generated in the first terminal section 3 of the FPC 2 to which the middle-stage contacts 30*b* are connected. Moreover, the strain relief member 17*c* provided on the lower-stage base housing 11*c* is similarly caused to pivot about the hinge part 27*c*, so that the strain relief projection 18*c* is engaged with the hole part 26*c* via an opening 5 formed in the FPC 2, and the locking projections 19*c* are locked with the locking holes 25*c*, thus locking the strain relief member 17*c*. As a result, in cases where an external force is applied to the FPC 2, it is possible to relieve the stress generated in the first terminal section 3 of the FPC 2 to which the lower-stage contacts 30*c* are connected. Consequently, in cases where vibration occurs, the stress generated in the first terminal sections 3 of the FPC 2 can be relieved by the strain relief members 17*a*, 17*b*, and 17*c*, which makes it possible to produce an electrical connector that is suitable for use as an automotive connector. As a result, the state shown in FIG. 9 is obtained.

Next, the respective upper-stage, middle-stage, and lower-stage base housings 11*a*, 11*b*, and 11*c* are successively passed through an opening in the transmission case.

Figure 10:
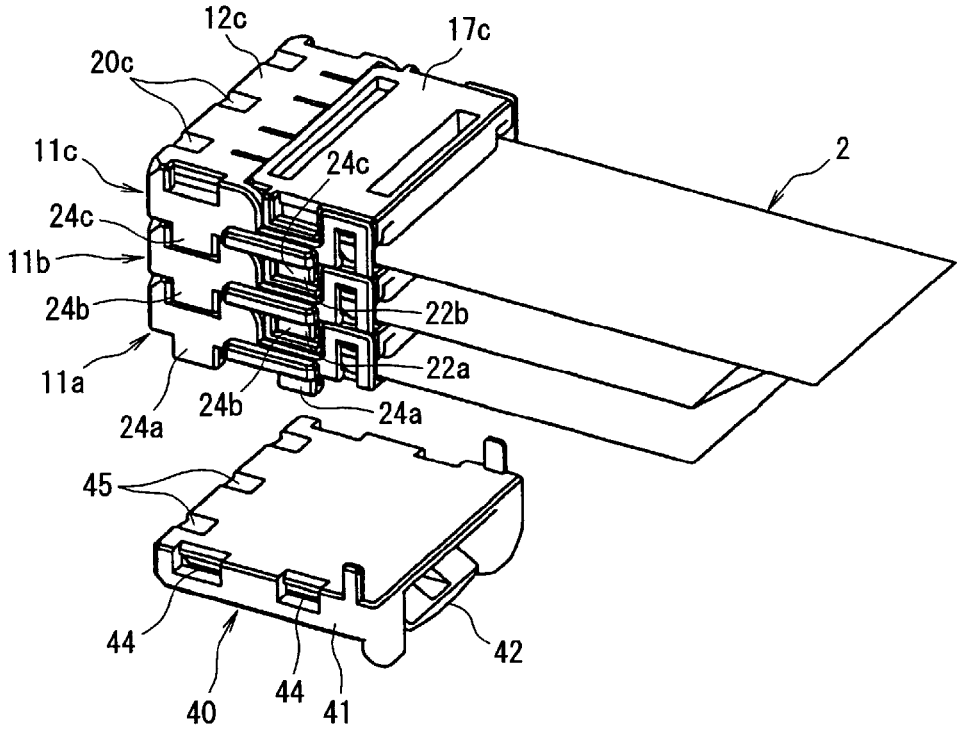
FIG. 10 is a perspective view illustrating a step of attaching a lock housing to the upper-stage base housing that is located at the very top of the stacked upper-stage, middle-stage, and lower-stage base housings.
Figure 11:
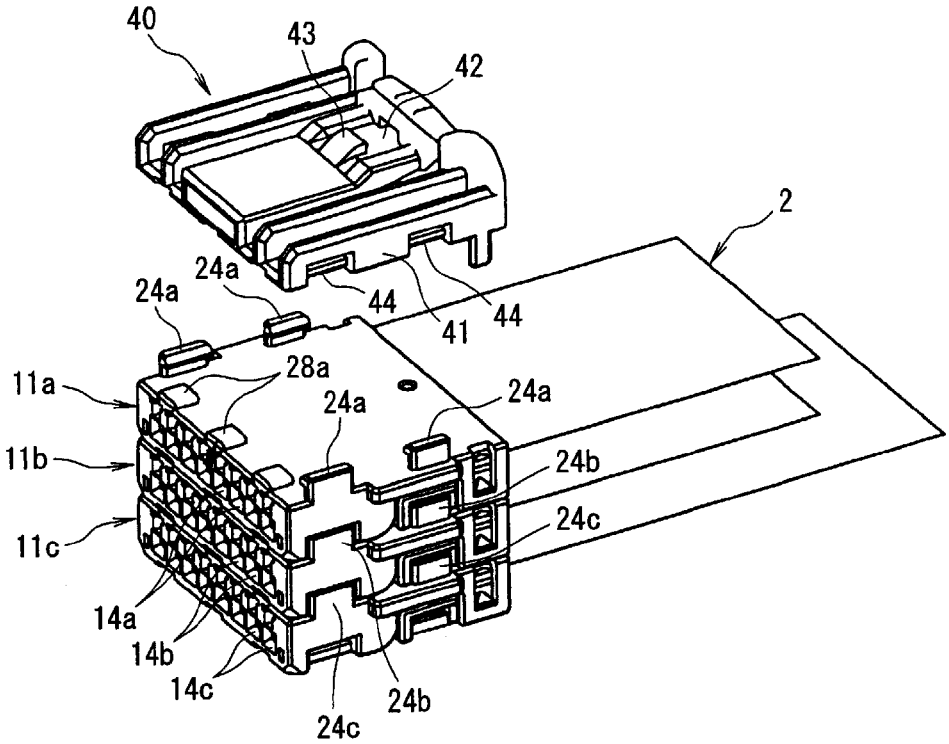
FIG. 11 is a perspective view illustrating a step of attaching a lock housing to the upper-stage base housing that is located at the very top of the stacked upper-stage, middle-stage, and lower-stage base housings.
Figure 12:
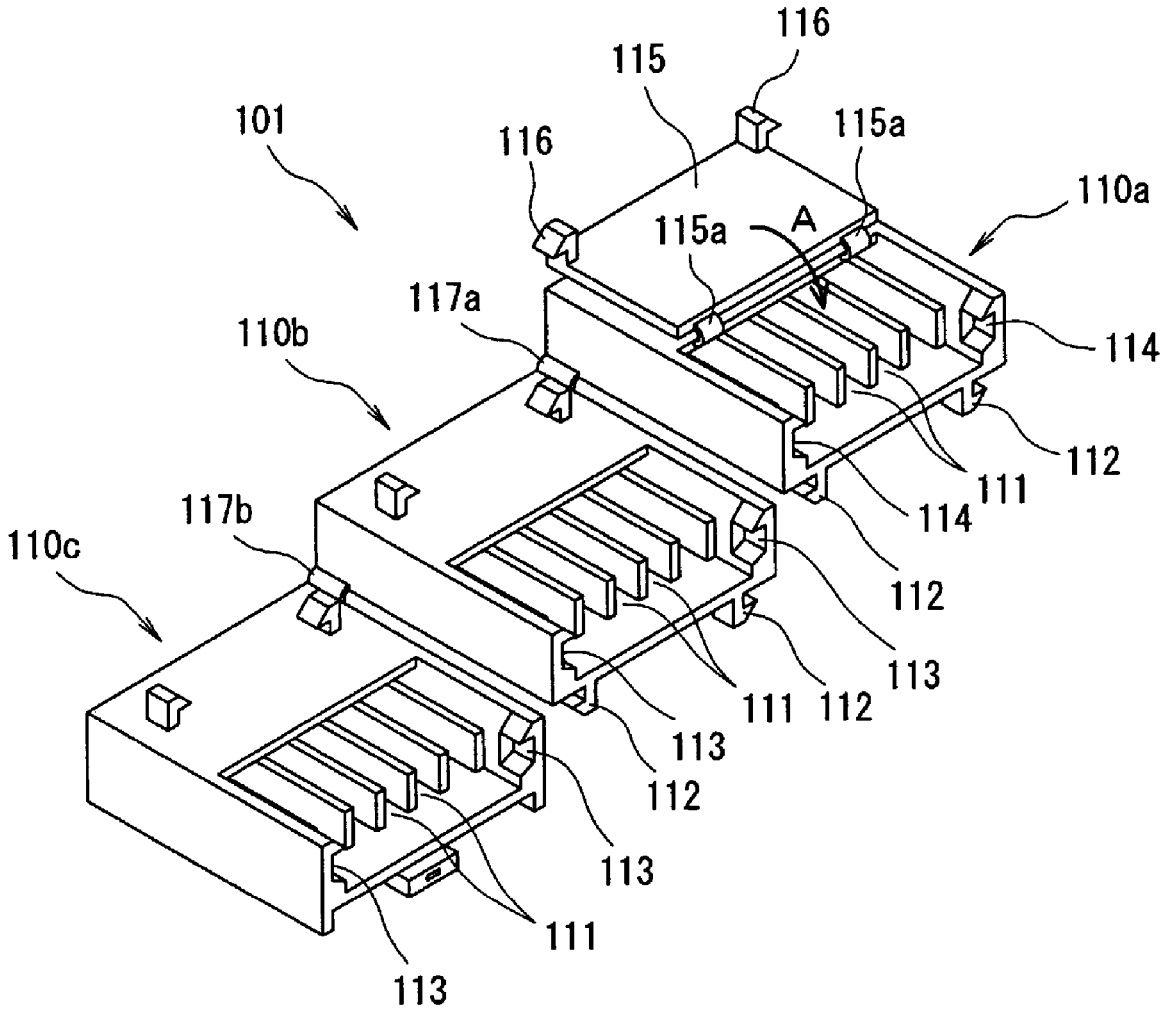
FIG. 12 is a perspective view of the upper-stage, middle-stage, and lower-stage base housings constituting a conventional example of a connector.
Figure 13A:
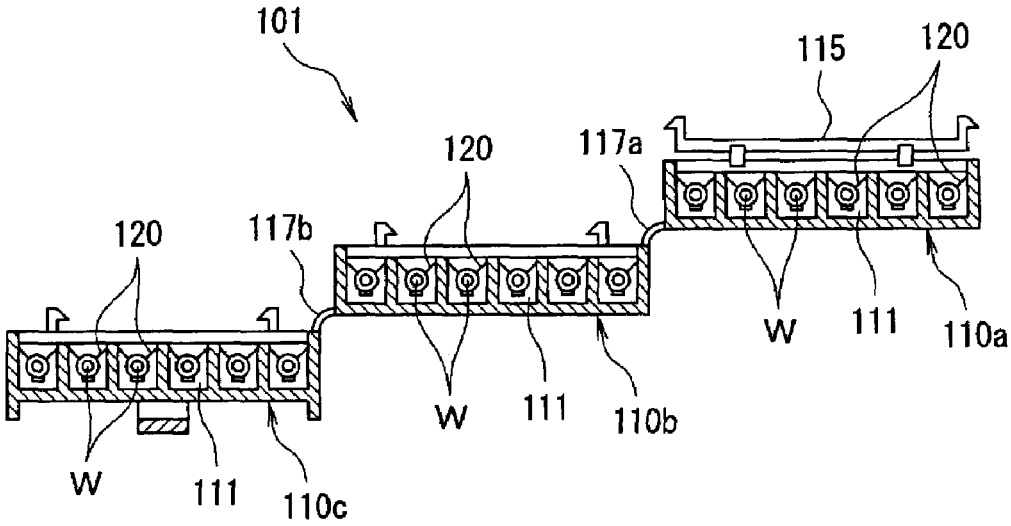
FIGS. 13A to 13C are explanatory diagrams of a conventional example of a connector assembly.
Figure 13B:
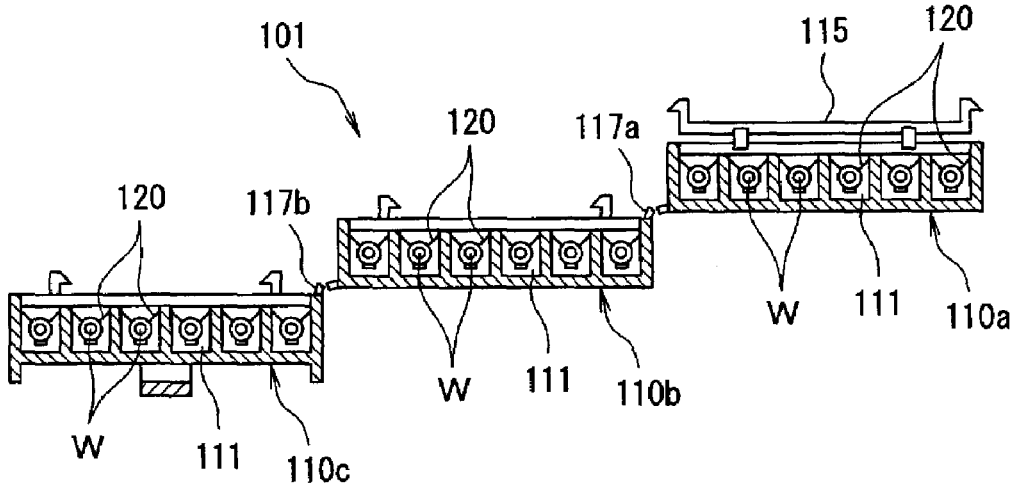
Figure 13C:
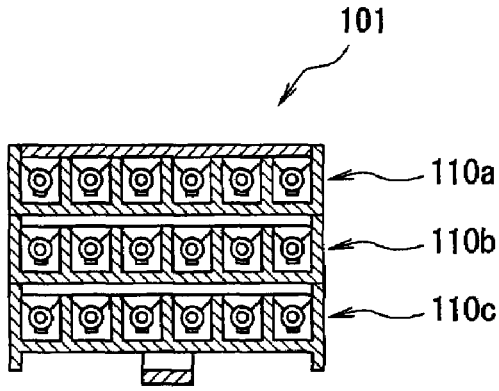

Subsequently, by folding the FPC 2, the middle-stage base housing 11*b* is stacked on top of the lower-stage base housing 11*c*, and the upper-stage base housing 11*a* is stacked on top of the middle-stage base housing 11*b* as shown in FIGS. 10 and 11. In this case, the locking projections 24*c*, 24*c* of the lower-stage base housing 11*c* engage with the locking recesses 21*b*, 22*b* of the middle-stage base housing 11*b*, so that the lower-stage base housing 11*c* and middle-stage base housing 11*b* are locked together. Furthermore, the locking projections 24*b*, 24*b* of the middle-stage base housing 11*b* engage with the locking recesses 21*a*, 22*a* of the upper-stage base housing 11*a*, so that the middle-stage base housing 11*b* and upper-stage base housing 11*a* are locked together. The protruding parts of the lower-stage base housing 11*c* are fitted into the grooves 20*b* in the middle-stage base housing 11*b*, thus preventing excessive looseness between the lower-stage base housing 11*c* and middle-stage base housing 11*b*, and the protruding parts of the middle-stage base housing 11*b* are fitted into the grooves 20*a* in the upper-stage base housing 11*a*, thus preventing excessive looseness between the middle-stage base housing 11*b* and upper-stage base housing 11*a*.

Finally, the lock housing 40 is attached to the surface of the upper-stage base housing 11*a* located in the uppermost position of the stacked upper-stage, middle-stage, and lower-stage base housings 11*a*, 11*b*, and 11*c*. In this case, the locking projections 24*a*, 24*a* of the upper-stage base housing 11*a* engage with the locking recesses 44, 44 in the lock housing 40, so that the lock housing 40 is locked with the upper-stage base housing 11*a*. Furthermore, the protruding parts 28*a* of the upper-stage base housing 11*a* are fitted into the grooves 45 in the lock housing 40, thus preventing excessive looseness of the lock housing 40. As a result, arrangement of the wire harness 1 is completed.

In this method for arranging wire harness 1, after the plurality of contacts 30*a*, 30*b*, and 30*c* are connected to the FPC 2, the plurality of contacts 30*a*, 30*b*, and 30*c* are respectively inserted into the contact receiving cavities 16*a*, 16*b*, and 16*c* in a single row in the upper-stage, middle-stage, and lower-stage base housings 11*a*, 11*b*, and 11*c*, and the respective upper-stage, middle-stage, and lower-stage base housings 11*a*, 11*b*, and 11*c* are successively passed through the opening in the transmission case, after which the upper-stage, middle-stage, and lower-stage base housings

11*a*, 11*b*, and 11*c* are stacked, thus accomplishing the arrangement of the wire harness 1. Accordingly, the opening bored in the transmission case can be made small. Furthermore, there is no need to cut thin parts that are provided in order to form a plurality of base housings as one linked body in a single molding process as in the past, so that arranging of wire harness is facilitated and simplified. Moreover, since the upper-stage, middle-stage, and lower-stage base housings 11*a*, 11*b*, and 11*c* are formed to be mutually stackable and have the same shape, the number of parts is small, and when the number of base housings is increased or decreased in cases where the number of poles of the contacts is increased or decreased, it is not necessary to manufacture a new mold, so that it is possible to obtain an electrical connector at a low cost with a high degree of freedom in the housing construction.

In addition, the plurality of contacts 30*a*, 30*b*, and 30*c* connected to the FPC 2 are respectively inserted in the contact receiving cavities 16*a*, 16*b*, and 16*c* in a single row in the upper-stage, middle-stage, and lower-stage base housings 11*a*, 11*b*, and 11*c*, so that the contact accommodation work is easier than in the case of inserting a plurality of contacts connected to an FPC in the contact receiving cavities that are formed in multiple rows to begin with, and the contact accommodation work by means of an automated device or the like also becomes possible.

An embodiment of the present invention has been described above. However, the present invention is not limited to this embodiment, and various alterations and modifications can be made.

For example, it is sufficient if the electrical connector 10 is a connector that is connected to a flat cable such as a flexible flat cable (FFC) other than an FPC.

Furthermore, not only to one end of an FPC 2 (flat cable), but the electrical connector 10 may also be connected to both one end and the other end, or only to the other end, or may also be connected to a connecting part that is branched out from an intermediate portion of the FPC 2.

Moreover, as long as the electrical connector 10 comprises a plurality of mutually stackable base housings, this electrical connector is not limited to a connector comprising upper-stage, middle-stage, and lower-stage base housings 11*a*, 11*b*, and 11*c*.

In addition, in the embodiment described above, a lock housing 40 is attached only to the upper surface of the upper-stage base housing 11*a*. However, it would also be possible to attach two lock housings 40 to both the upper-stage and lower-stage base housings 11*a* and 11*c*, or to attach a lock housing 40 only to the undersurface of the lower-stage base housing 11*c*. In other words, it is sufficient if at least one lock housing is attached to the uppermost and/or lowermost base housing of the plurality of stacked base housings.

Furthermore, the use of the wire harness 1 is not limited to a case in which this wire harness 1 is used for the connection to a controller for an automotive transmission; this wire harness may also be used in another electrical circuitry. Moreover, when arranging wire harness 1, the respective upper-stage, middle-stage, and lower-stage base housings 11*a*, 11*b*, and 11*c* may also be passed successively through an opening bored in a housing other than a transmission case.

What is claimed is:

1. An electrical connector connected to a flat cable, comprising:

a plurality of mutually stackable base housings having the same shape, each stackable base housing being configured for direct locking engagement with adjacently stacked base housings, with each of these base housings having contact receiving cavities in a single row;

at least one lock housing that is attached to the uppermost and/or lowermost base housing of the plurality of stacked base housings; and a plurality of contacts that are connected to the flat cable and that are inserted into the contact receiving cavities in the plurality of base housings.

2. The electrical connector according to claim 1, wherein a strain relief member that relieves the stress generated in the flat cable when an external force is applied to the flat cable is provided in an integral manner on each of the plurality of base housings via a hinge part.

3. A wire harness in which an electrical connector is connected to a flat cable, wherein the electrical connector comprises: a plurality of mutually stackable base housings having the same shape, each stackable base housing being configured for direct locking engagement with adjacently stacked base housings, with each of the base housings having contact receiving cavities in a single row; at least one lock housing that is attached to the uppermost and/or lowermost base housing of the plurality of stacked base housings; and a plurality of contacts that are connected to the flat cable and that are inserted into the contact receiving cavities in the plurality of base housings.

4. The wire harness according to claim 3, wherein a strain relief member that relieves the stress generated in the flat cable when an external force is applied to the flat cable is provided in an integral manner on each of the plurality of base housings via a hinge part.

* * * * *